United States Patent [19]

Yasukochi et al.

[11] Patent Number: 4,471,625

[45] Date of Patent: Sep. 18, 1984

[54] GAS CYCLE REFRIGERATOR

[75] Inventors: Kou Yasukochi; Yoshinobu Baba, both of Tokyo; Youichi Matsubara, Funabashi, all of Japan

[73] Assignee: Kabushiki Kaisha Suzuki Shokan, Japan

[21] Appl. No.: 447,639

[22] Filed: Dec. 7, 1982

[51] Int. Cl.[3] ..... F25B 9/00

[52] U.S. Cl. ..... 62/6; 60/520

[58] Field of Search ..... 62/6; 60/517, 520

[56] References Cited

U.S. PATENT DOCUMENTS

| | | | |
|---|---|---|---|
| 3,640,082 | 2/1972 | Dehne | 62/6 |
| 3,690,113 | 9/1972 | Mokadam | 62/6 |
| 3,698,182 | 10/1972 | Knoos | 62/6 |
| 3,733,837 | 5/1973 | Lobb | 62/6 |

*Primary Examiner*—Ronald C. Capossela

*Attorney, Agent, or Firm*—Quaintance & Murphy

[57] ABSTRACT

In a gas cycle refrigerator having a compressor (10), a gas expansion vessel containing a displacer (3, 37), a switch valve means (11, 12) between the vessel and the compressor, and a heat accumulator (15) between gas expansion chambers (21, 23) at both ends of the displacer within the vessel, the conduit between the switch valve means and one gas expansion chamber (21) has a resistance to gaseous cooling medium which substantially corresponds to the pressure loss in the heat accumulator so that pressure will change substantially at the same rate in both the gas expansion chambers at both ends of the displacer (21, 23) and thus will not undergo an undesirable force which may occur due to a difference in pressure between the gas expansion chambers. A compact structure of switch valve in such refrigerator is also disclosed.

13 Claims, 6 Drawing Figures

GAS CYCLE REFRIGERATOR

BACKGROUND OF THE INVENTION

1. Filed of the Invention

The present invention relates to a refrigerator, more specifically to a gas cycle refrigerator consisting of a compressor, a gas expansion vessel, a heat accumulator, and a switch valve. In a gas cycle refrigerator of this type, for instance helium gas pressurized by the compressor is introduced via the switch valve into the gas expansion vessel, where the pressurized gas expands and cools to a very low temperature of, say, about 20° K.; the heat accumulator is maintained at the very low temperature by the cold gas so that refrigeration can be provided for some object to be refrigerated; the gas is then returned via the same switch valve to the compressor, this cycle being repeated.

The gas expansion vessel comprises a cylinder and a displacer piston slidably mounted within the cylinder so that a plurality of gas expansion chambers are defined between the cylinder and the displacer within the cylinder. The gas expansion chambers communicate with one another through the heat accumulator.

One of the gas expansion chambers located at one end of said cylinder is connected to the switch valve and in operation this chamber remains warmer than the other chambers, usually at about the room temperature.

2. Description of Prior Art

Usually in the conventional gas cycle refrigerator of this type, when a pressurized gas from the compressor is supplied via the switch valve to the gas expansion vessel, the pressures at both ends of the displacer will rise, but thereby a pressure loss will occur in the heat accumulator and in consequence the pressure rise at the low-temperature end of the cylinder will be delayed as compared with that at the high-temperature end of the cylinder. In this gas supply stage the displacer has to be moved from the low-temperature end to the high-temperature end, but the difference in the rate of pressure rise will hinder the required movement of the displacer. In the stage of the working gas being returned to the compressor from the gas expansion vessel, the pressure loss in the heat accumulator likewise results in a difference of pressure fall at both ends of the displacer which will hinder the displacer movement. In consequence a large force will be needed to drive the displacer.

SUMMARY OF THE INVENTION

One object of the present invention is to provide an improved gas cycle refrigerator of said type in which the force hindering the displacer movement is minimized.

Another object of the present invention is to provide an improved gas cycle refrigerator of said type which is characterized by simplicity and compactness of structure.

To attain these objects, in a gas cycle refrigerator according to the present invention the flow resistance of the gaseous cooling medium in the duct means connecting the compressor and the high-temperature side gas expansion chamber is set approximately equal to the pressure drop in the heat accumulator.

BRIEF DESCRIPTION OF DRAWINGS

These and other objects, features and advantages of the present invention will be apparent from the following description and the accompanying drawings, in which.

DETAILED DESCRIPTION OF THE PREFERRED EMBODIMENTS

Figure 1:
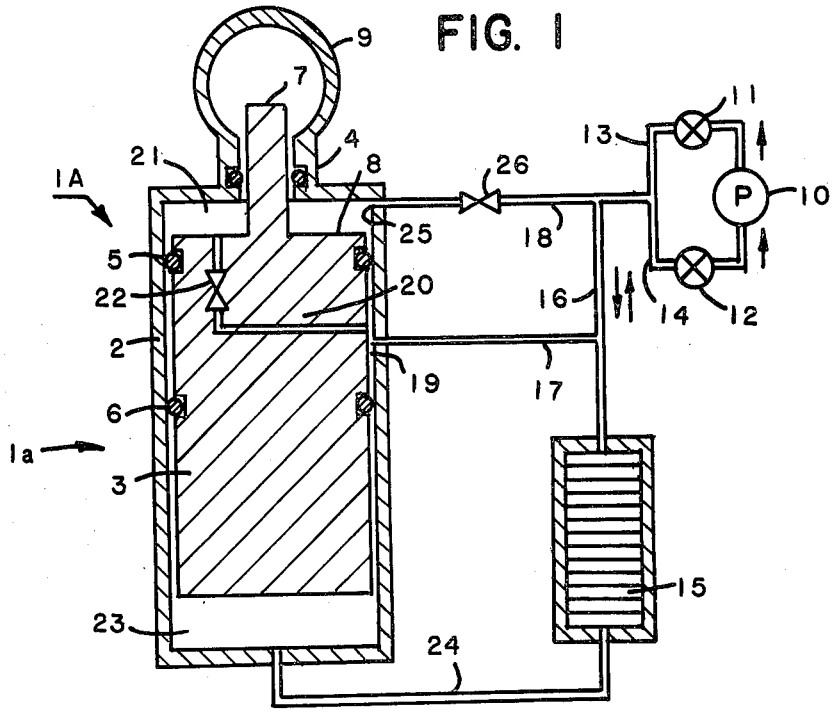
FIG. 1 is a partial sectional view of one embodiment of the present invention, in which two selectively employed duct means are provided between the compressor and the high-temperature side gas expansion chamber.

One embodiment of the present invention is to be described referring to FIG. 1, in which 1*a* is a gas expansion vessel having a displacer piston 3 slidably mounted in a cylinder 2. On the outside of the displacer 3 are fitted seal rings 4, 5 and 6 which maintain gas tightness between the displacer 3 and the cylinder 2. The upper portion of the displacer 3 comprises a small-diameter section 7 and a large-diameter section 8, said small-diameter section 7 being exposed to the gas pressure of a constant-pressure chamber 9. The pressure in the chamber 9 is held at the average of the suction pressure and the exhaust pressure of a compressor 10, i.e., an intermediate pressure between minimum and maximum pressures in the cylinder 2, said intermediate pressure acting on the small-diameter section 7.

The compressor 10 is connected to one ends of the pipes 13 and 14 respectively having switch valves 11 and 12 midway. The pipes 13 and 14 are connected to the exhaust port and the suction port, respectively, of the compressor 10. The other ends of said pipes 13 and 14 converge and connect to one end of the pipe 16 whose other end is connected to the high-temperature side of a heat accumulator 15 including therein a gas-passing body of large thermal capacity, say, metal screen. From said pipe 16 branch out two pipes 17 and 18. The tip of pipe 17 goes into a hole 19 bored in the side wall of the cylinder 2 and communicates via a path 20 provided in the displacer 3 to an upper chamber 21 of the cylinder 2, which is the high temperature side gas expansion chamber. Midway in said path 20 there is installed a flow path resistance 22. A lower chamber 23 connects through a pipe 24 to the low-temperature side of the heat accumulator 15. At the top of the cylinder 2 opens a hole 25, into which goes the pipe 18 equipped midway with a flow path resistance 26. The refrigerator according to the present invention needs at least either the flow path marked 18, 26 and 25 or the flow path marked 17, 19, 20 and 22.

In a refrigerator thus constituted, the displacer 3 is reciprocated by the action of the pneumatic mechanism 9 within the cylinder 2 and at the same time the valves 11 and 12 are alternately opened or closed. Here a refrigerator equipped with, say, the flow path 17, 19, 20 and 22 is to be described. At first, a gas such as helium pressurized to a specific level by the compressor 10 flows through opened valve 11 and pipes 13 and 16, one part of said gas going via the heat accumulator 15 and the path 24 into the lower chamber 23 of the cylinder and the rest of it going through the pipe 17 into a space enclosed with the internal seal rings 5 and 6 within the cylinder 2 and therefrom into the upper chamber 21 of the cylinder 2 via the flow path resistance 22.

If thereby the pressure loss in the heat accumulator 15 is approximately equal to the pressure loss due to the flow path resistance 22, the drive force of the gas pressure acting on the displacer 3 will depend not on the size of the large-diameter section 8 but on said intermediate pressure (between minimum and maximum pressures in the cylinder 2) acting on the small-diameter section 7 from the constant-pressure chamber 9. Therefore, when the pressure in the cylinder 2 exceeds said intermediate pressure, the displacer will shift upward in the drawing causing the pressurized gas to flow into the lower chamber 23.

Next, when the valve 11 is closed and the valve 12 is opened, the process in said gas suction stroke will be reversed, causing the pressurized gas to be expanded and exhausted. In this expansion-exhaust stroke too, the large-diameter section 8 will not drive the displacer 3 on account of the presence of said flow path resistance 22 and the displacer 3 will begin to fall only when the pressure in the cylinder becomes lower than the pressure acting on the small-diameter section 7.

In this manner by alternate action of the valves 11 and 12, the displacer 3 can be reciprocated to provide cold in the lower chamber 23. The same action can be obtained either with use of the flow path 17, 19, 20 and 22 or with use of the flow path 18, 26 and 25. Suppose here that the flow path resistance 22 or 26 is absent. Then, as long as there is a pressure drop in the heat accumulator 15, the pressure acting on the large-diameter section 8 will in the initial stage of switching the valves 11 and 12 be higher than the pressure in the lower chamber 23 at the compression stroke and lower than that at the expansion stroke. This implies that there is working a force which urges the displacer 3 in a direction opposite to the direction of movement of the displacer; and in consequence the displacer 3 collides with the cylinder 2, causing undesirable big noises and vibrations.

Figure 2:
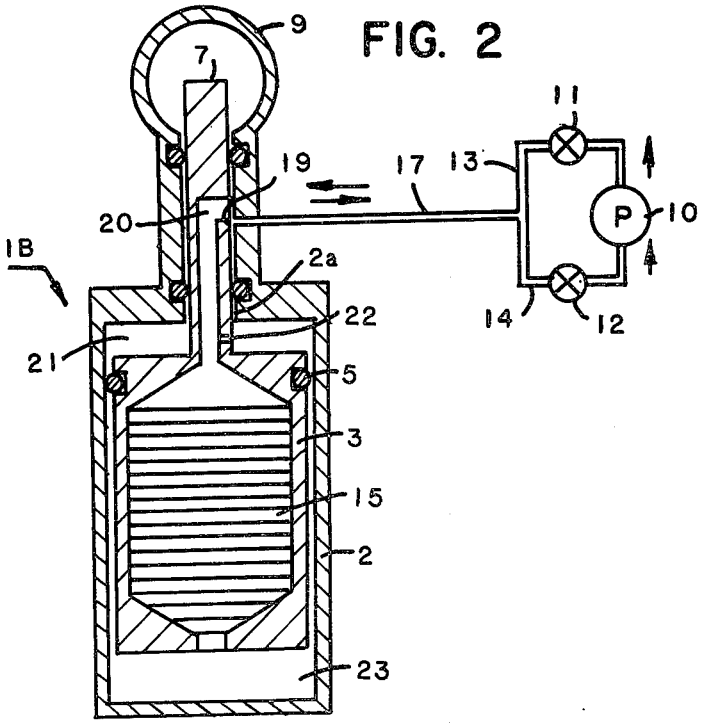
FIG. 2 is a partial sectional view illustrating a variation of the embodiment in FIG. 1.

In an appropriate application of the present invention it will be possible to design such that in the vicinity of the top dead position of the displacer 3 the magnitude of said flow path resistance is made larger depending on the relative position of the displacer 3 to the cylinder 2. FIG. 2 illustrates an example of such designing, in which the heat accumulator 15 is located within the displacer 3.

Like parts with like functions in FIGS. 1 and 2 bear the same symbols and accordingly FIG. 1 should be referred to.

The merits derived from such designing are as follows.

At the top dead position of the displacer 3, the volume of the upper chamber 21 is minimum and that of the lower chamber 23 is maximum.

When thereby the valve 12 opens, the gas in the expansion vessel is sucked into the compressor 10. In consequence the pressures in the lower chamber 23 and in the upper chamber 21 will fall with time lapse, but the rate of pressure drop in the upper chamber 21, whose volume is smaller than that of the lower chamber 23, will be accelerated.

In the embodiment of FIG. 2, however, the flow path resistance is designed particularly high near the top dead position of the displacer 3 so that the pressure drop rate of the upper chamber 21 may be equal to the pressure drop rate of the lower chamber 23. Thus in the embodiment of FIG. 2, it is arranged such that only when the displacer 3 is near the top dead position, the opening 22 of the small-diameter section 7 which communicates the flow path 20 to the upper chamber 21 comes closely opposite to a specific portion 2*a* of the inner wall of the cylinder 2. Accordingly when the displacer 3 is near the top dead position, the flow path resistance between the valves 11 and 12 and the upper chamber 21 will be particularly high. If, on the contrary, said flow path resistance is set constant at a specific large value regardless of the displacer position so that the pressure changes in the upper and lower chambers may be equal only near the top dead position, the result will be such that, when the displacer is near the bottom dead position and a pressurized gas is supplied to the cylinder, the pressure change in the lower chamber 23, whose volume is smaller than that of the upper chamber 21, will take place much faster than the pressure change in the upper chamber 21, causing a sudden reversal in the displacer movement direction. Such a sudden reversal in the movement will cause mechanical vibrations, especially when the displacer has a large inertia; and may deteriorate the pressure-volume change characteristics required for efficient refrigeration.

Figure 3:
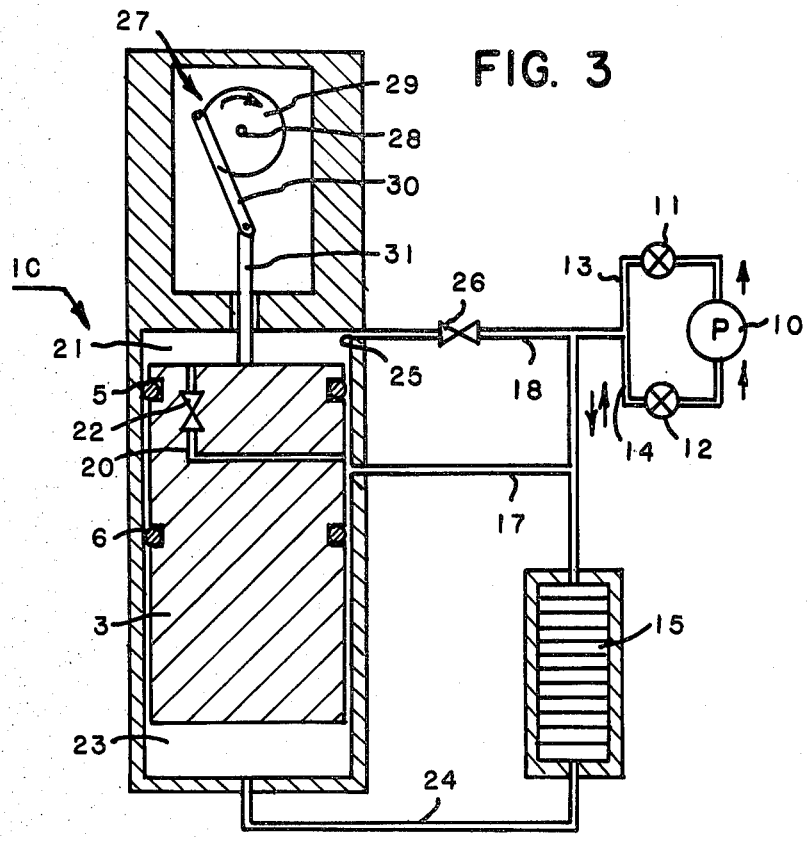
FIG. 3 is a partial sectional view illustrating another embodiment of the present invention.

FIG. 3 illustrates another embodiment of the present invention. In this embodiment the reciprocating movement of the displacer 3 relies not on the pneumatic mechanism 9 but on the crank mechanism 27, which is composed of a rotating plate 29 connected to a rotatable shaft 28 rotated by a drive means (not shown) such as an electric motor; a connecting rod 30; and a piston rod 31, otherwise the structure being the same as in FIG. 1. However, with no need for providing a stepped displacer 3, the pressurized gas entering the upper chamber 21 via the hole 25 or the flow resistance 22 acts on the entire surface of the displacer 3, thereby cooperating with the crank mechanism 27.

During normal operation for refrigeration the plate 29 is rotated in a predetermined direction to reciprocate the displacer 3 and the valves 11 and 12 are so actuated that the pressurized gas is supplied to the gas expansion vessel as the displacer 3 moves upward and the gas is exhausted into the compressor as the displacer moves downward. In this embodiment, when the temperature should be raised for certain reasons, the plate 29 is rotated in the reversed direction and the valves 11 and 12 are actuated so that the pressurized gas is supplied into the vessel as the displacer moves downward and the gas is exhausted into the compressor as the displacer moves upward. During this heating operation, the flowing gaseous medium will act as a thermal energy transferring medium and the temperature will be raised quickly without any additional heating device.

Figure 4:
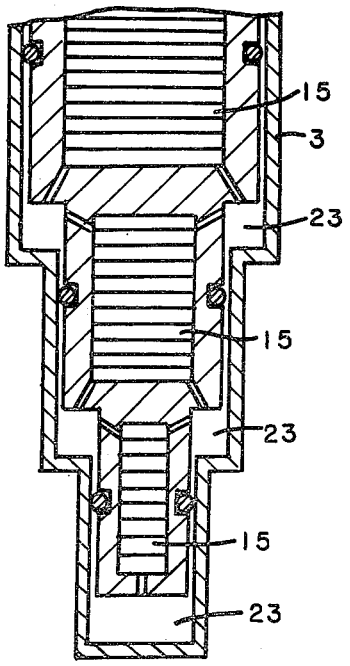
FIG. 4 is a sectional view of details of a variation of the embodiments illustrated in FIGS. 1, 2, and 3.

Usually for the purpose of generating a cryogenic temperature (for instance, 20° K.), it is necessary to have a multi-stage gas expansion vessel (for example, 2-stage vessel) with the lower chamber 23 in a multi-split structure on the same axis. The present invention applies as it is even to such a multi-stage gas expansion vessel. FIG. 4 illustrates a three-stage structure of the lower chamber 23.

In a drive system utilizing the pneumatic mechanism as shown in FIGS. 1 and 2, the effect of the present invention is still more enhanced through such arrangement that for the purpose of deciding the displacer stroke the displacer position is detected just before the top and bottom dead positions and the valves 11 and 12 can be switched by the signals issued upon the detection.

In the above embodiments under such arrangement there is an advantage that the displacer can be driven by a smaller force than in the conventional design.

Figure 5:
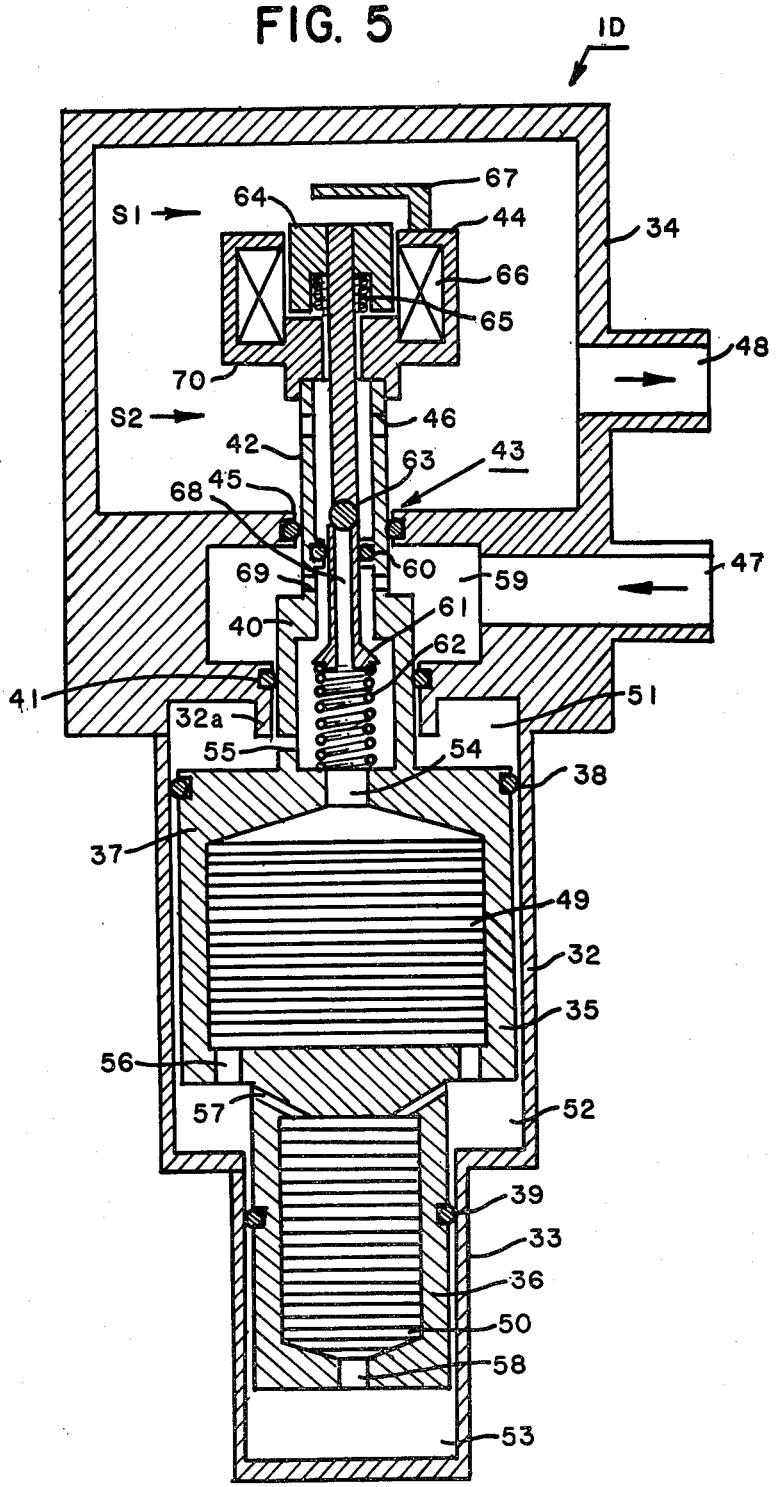
FIG. 5 is a sectional view of a further embodiment of the present invention.
Figure 6:
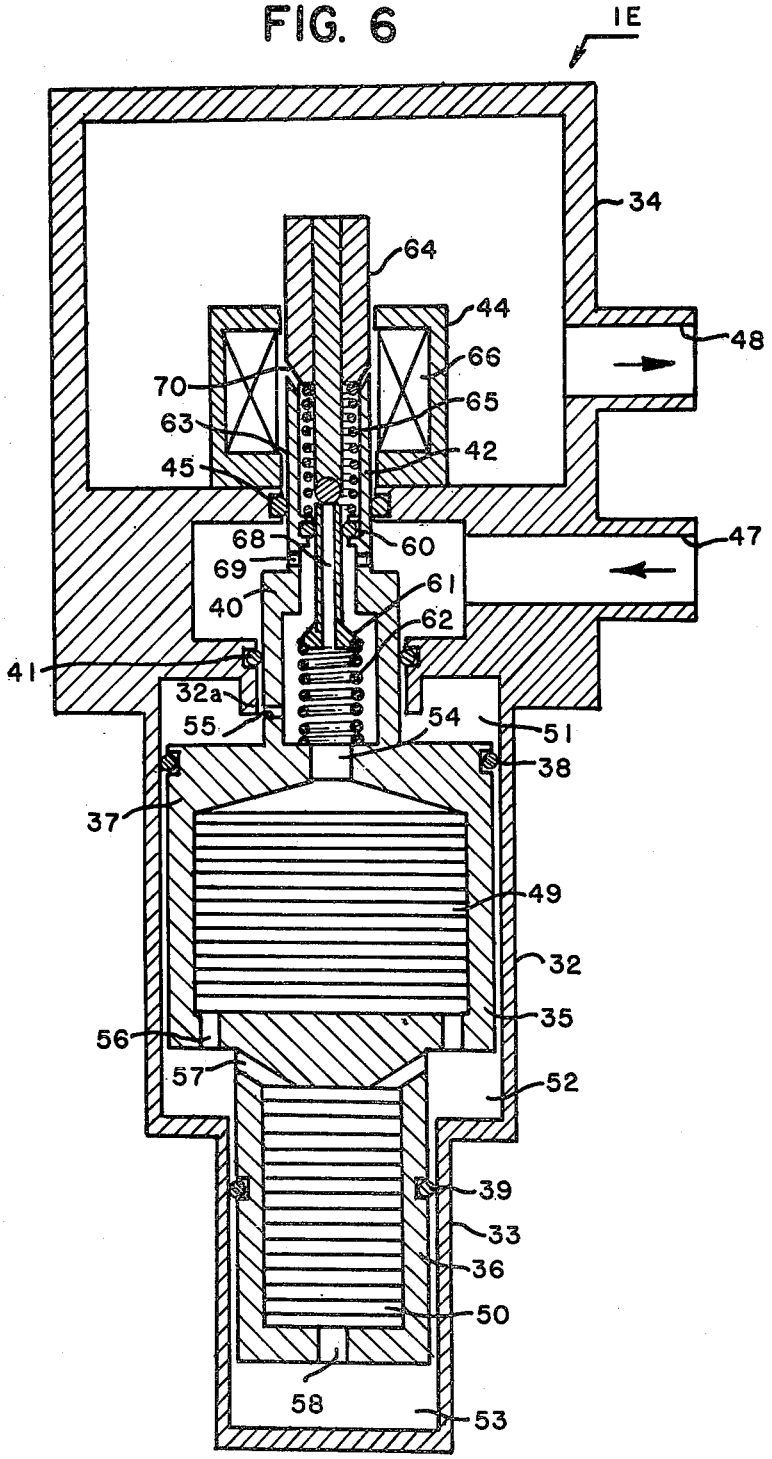
FIG. 6 is a sectional view of a still another embodiment the present invention.

FIGS. 5 and 6 illustrate gas cycle refrigerators 1D and 1E, i.e., other embodiments of the present invention. As stated later, in the refrigerators 1D and 1E just as in 1B of FIG. 2, the resistance in the flow path running from the compressor to the upper chamber 51 is so designed as to become particularly large when the displacer comes near the top dead position. Prominent features of 1D and 1E lie in the composition of the switch valve located between the compressor and the cylinder as well as in said flow resistance which is variable depending on the displacer position.

The refrigerator 1D of FIG. 5 will now be described. In FIG. 5, 32 and 33 are cylinder portions and 34 is a casing integrated to the cylinder portions 32 and 33. As shown, said cylinder portions 32 and 33 with different diameters are coaxially stacked one over the other to form a stepped cylinder. Within this cylinder two-stage displacer 37 consisting of a large-diameter section 35 and a small-diameter section 36 are mounted slidably by means of seal rings 38 and 39. The upper portion of the displacer 37 has a decreased diameter and this decreased-diameter portion 40 is slidably fitted to the top of the cylinder portion 32 by means of a seal ring 41.

The uppermost portion 42 of the displacer 37 upward of said decreased-diameter portion 40 constitutes a high-temperature end of the displacer 37 and a part of the valve mechanism 43 to be described later. The portion 42 is fitted to the casing 34 by means of a seal ring 45 and it carries a hole 46 at the top. The casing 34 is equipped with a high-pressure gas suction port 47 and a low-pressure gas exhaust port 48. The suction port 47 connects to the exhaust port of a compressor (not shown), while said exhaust port 48 connects to the suction port of said compressor.

The large-diameter portion 35 and the small-diameter portion 36 of the displacer 37 are hollow and they house heat accumulators 49 and 50. Above and below the large-diameter portion 35 within the cylinder portion 32 chambers 51 and 52 are formed, and between the small-diameter portion 36 and the bottom of the cylinder portion 33 a chamber 53 is formed. The upper part of the heat accumulator 49 connects to a hole 54 inside the decreased-diameter portion 40. Between the hole 54 and the chamber 51 there is a path 55 having a flow resistance. The heat accumulator 49 communicates with the chamber 52 via paths 56. Another heat accumulator 50 communicates with the chamber 52 via paths 57, and further communicates with the chamber 53 via a path 58.

The valve mechanism 43 serves to make or break communication between the hole 54 is the decreased-diameter portion 40, the hole 46 in the upper portion 42 and a space 59. The valve mechanism 43 consists of a valve body 61 tightly and slidably installed in the hole 46 by means of a seal ring 60; a spring 62 urging said valve body 61 in the closing direction; a ball 63 pressing the valve body 61 in the opening direction; a plunger 64 pressing the ball 63; and a spring 65 urging the plunger in the opening direction. When the coil 66 of the solenoid 44 is energized with an electric current, the plunger 64 will move downward in the drawing. The coil 66 is fixed relative to only the upper portion 42 which supports the coil. Above the plunger 64 there is provided a stop device 67 to prevent the plunger 64 from jumping out. Valve body 61 has a hole 68 bored therein and there is a passage 69 provided between the decreased-diameter portion 40 and the upper portion 42.

In the refrigerator 1D thus constituted, appropriate sensors are provided at the positions S1 and S2 in the drawing, said sensors serving to sense the position of the displacer 37 and control energization of the coil 66. If the sensor S2 causes energization of the coil 66 when the displacer 37 is near the bottom dead position, the plunger 64 is lowered to make the valve body 61 compress the spring 62, thereby opening the valve; and thereupon a high-pressure gas will flow into the hole 54 through the passage 69, into the chamber 51 through the passage 55, into the chamber 52 through the passages 56, and then into the chamber 53 through the passage 58, thus causing the displacer 37 to rise.

Next the rising displacer 37 is sensed by the sensor S1 and the coil 66 will be de-energized. Thus the valve body 61 will be closed, but the hole 68 centrally bored in the valve body 61 will be opened, because the ball 63 detaches from the valve body 61. The high-pressure gas held in the chambers 52 and 53 will be expanded and cooled as it passes through the heat accumulators 49 and 50. Thereby an object placed around the cylinder portions 32 and 33 for the purpose of being cooled will be cooled. And then the gas in the chambers 51, 52 and 53 will be discharged out of the exhaust port 48 via the passages 55, 56 and 58, respectively, thereby causing the displacer 37 to lower. This process will be repeated.

FIG. 6 illustrates still another embodiment of the present invention. In this embodiment the coil 66 of the solenoid is directly mounted on the internal wall of the casing 34 and only the plunger 64 is mounted on the high-temperature end of the displacer by means of a compression spring 65. For the purpose of effective exploitation of the magnetic flux in the coil 66 over the entire stroke of the displacer, however, it would be necessary to fabricate at least the upper portion 42 of iron or other magnetic materials; and also it would be necessary to fabricate the large-diameter portion of the plunger 64 of iron or other magnetic materials and make said portion about as long as or longer than the length of the entire stroke.

Under this arrangement it is so designed that the gap 70 formed between the plunger 64 and the upper portion 42 of the displacer can reciprocate always within the coil 66. If under this condition it is so arranged that the coil 66 is energized near the bottom dead position and deenergized near the top dead position, the reciprocation of the displacer will take place by a pneumatic force in the same manner as the embodiment in FIG. 1. Switching between energization and deenergization of the coil 66 can be made to take place at the top dead position and the bottom dead position, or at other positions between them, by means of suitable position detectors such as photosensors.

The arrangement in the embodiments 1D and 1E in FIGS. 5 and 6 is similar to that of the embodiment 1B of FIG. 2; namely, when the displacer 37 is located near the top dead position, the opening 55 of the decreased-diameter portion 40 of the displacer comes closely opposite to a specified area 32*a* of the cylinder internal wall. Accordingly the resistance in the flow path from the compressor to the upper chamber 51 will be higher when the displacer is near the top dead position than when the displacer is at other positions. Thus the embodiments 1D and 1E have the same advantages as those of 1B.

In the embodiments 1D and 1E shown in FIGS. 5 and 6, where a single solenoid 44 serves to open and close two valves, the device will be smaller than in the conventional one with two separate valves. Moreover since the valve end comes not on a mount or a cylinder but on a movable displacer 37, there is an advantage that the vibrations generated upon valve closing will not directly propagate outward.

Further in the embodiments shown in FIGS. 5 and 6, since the pressurized area due to a diameter difference between the decreased-diameter portion 40 and the upper portion 42 thereof is approximately equal to the pressurized area due to the diameter of the upper portion 42 and at the same time both high pressure and low pressure act on respective pressurized areas, the decreased-diameter portion as a whole will be simply subjected to an intermediate pressure between the suction and exhaust pressures of the compressor. Thus when the chambers 51, 52 and 53 are under high pressure, a lifting force will be generated; and when they are under low pressure, a lowering force will be generated. Besides it is so arranged that the gas pressures in respective spaces directly act on the heat accumulators through supply and exhaust ports and therefore the refrigerator can be extremely simplified in structure with few components and a higher reliability of performance. Meanwhile since the valve body 61 and the plunger 64 are coupled by means of the ball 63, the valve action will always be stable regardless of the plunger position.

We claim:

1. A gas cycle refrigerator comprising:

a compressor having a gas suction port and a gas exhaust port;

at least one gas expansion vessel comprising a cylinder, and a displacer mounted in said cylinder and slidable in the axial direction of said cylinder and forming a plurality of axially spaced gas expansion chambers between its outside and the internal wall of said cylinder;

a pneumatic drive means to drive said displacer in said axial direction and reciprocate said displacer, an upper portion of the displacer comprising a small-diameter section and a large-diameter section, said small-diameter section being exposed to the gas pressure of the pneumatic drive means;

at least one heat accumulator provided within a first duct means mutually communicating said plurality of gas expansion chambers; and a switch valve means provided in a second duct means connecting a first one of said plurality of gas expansion chambers adjacent to one end of said cylinder, to said compressor, and serving to selectively connect said suction portion or said exhaust port with said first gas expansion chamber, depending on the position of said displacer; and characterized in that the resistance of said second duct means to a flow of gaseous cooling medium is set approximately equal to a pressure drop in said first duct means due to said heat accumulator, whereby the pressure variations of gaseous cooling medium in said plurality of gas expansion chambers are approximately equal to one another.

2. A gas cycle refrigerator as claimed in claim 1, wherein said heat accumulator is located outside said cylinder.

3. A gas cycle refrigerator as claimed in claim 1, wherein said heat accumulator is located inside said displacer.

4. A gas cycle refrigerator as claimed in claim 2 or 3, wherein said resistance of said second duct means is variable with the position of said displacer.

5. A gas cycle refrigerator as claimed in claim 4, wherein said resistance is maximized at the top dead position of said displacer, that is, at a position where the volume of said first gas expansion chamber is minimized or near this position.

6. A gas cycle refrigerator comprising:

a compressor having a gas suction port and a gas exhaust port;

at least one gas expansion vessel comprising a cylinder, and a displacer mounted in said cylinder and slidable in the axial direction of said cylinder and forming a plurality of axially spaced gas expansion chambers between its outside and the internal wall of said cylinder;

a drive means to drive said displacer in said axial direction and reciprocate said displacer, said drive means comprising a crank mechanism which converts a rotational movement into the reciprocal movement of said displacer;

at least one heat accumulator provided within a first duct means mutually communicating said plurality of gas expansion chambers; and a switch valve means provided in a second duct means connecting a first one of said plurality of gas expansion chambers adjacent to one end of said cylinder, to said compressor, and serving to selectively connect said suction port or said exhaust port with said first gas expansion chamber, depending on the position of said displacer; and characterized in that the resistance of said second duct means to a flow of gaseous cooling medium is set approximately equal to a pressure drop in said first duct means due to said heat accumulator, whereby the pressure variations of gaseous cooling medium in said plurality of gas expansion chambers are approximately equal to one another.

7. A gas cycle refrigerator as claimed in claim 6, wherein said rotational movement can be caused in the reversed direction so as to quickly raise the temperature within said gas expansion vessel.

8. A gas cycle refrigerator comprising:

a compressor having a gas suction port and a gas exhaust port;

at least one gas expansion vessel comprising a cylinder, and a displacer slidably mounted in said cylinder and forming a plurality of axially spaced gas expansion chambers between said cylinder and said displacer;

at least one heat accumulator provided in a bore which is formed in said displacer to connect said gas expansion chambers with one another; and a switch valve means for connecting said heat accumulator selectively to said suction port or said exhaust port depending upon the position of said displacer;

said switch valve means comprising:

a valve casing fixed to said gas expansion vessel and having therein a first pressure chamber connected to said exhaust port and a second pressure chamber connected to said suction port;

a substantially tubular gas-passage member fixed at one end thereof to said displacer and extending through said first and second pressure chambers within said valve casing and having a bore therethrough which is communicated with said heat accumulator, said first pressure chamber, and said second pressure chamber through openings formed in the wall of said gas-passage member;

valve body means axially movably mounted in said bore of said gas-passage member for selectively shutting the communication between said first pressure chamber and said heat accumulator through said bore of said gas-passage member, or the communication between said second pressure chamber and said heat accumulator through said bore of said gas-passage member; and solenoid means mounted within said valve casing for driving said valve body means, whereby said solenoid means is intermittently energized to move said valve body means in dependence on the position of said displacer.

9. A gas cycle refrigerator as claimed in claim 8, wherein said valve body means includes:

a plunger axially extending in said bore of said gas-passage member and urged by a first spring means away from said displacer and driven by said solenoid means toward said displacer; and an inner tube with both ends open disposed in alignment with said plunger between said displacer and said plunger in said bore of said gas-passage member and urged by a second spring means away from said displacer and actuated with said plunger, said inner tube having at one end thereof opposite to one end of said plunger a first seat surface which sealingly engages with said one end of said plunger to shut the communication between said second pressure chamber and said heat accumulator when said solenoid is energized, and having on the outside thereof a radially outwardly extending projection which sealingly engages with a corresponding second seat surface on the inner wall of said gas-passage member to shut the communication between said first pressure chamber and said heat accumulator when said solenoid means is not energized.

10. A gas cycle refrigerator as claimed in claim 8 or 9, wherein said solenoid means has a coil fixed on the inner wall of said valve casing.

11. A gas cycle refrigerator as claimed in claim 8 or 9, wherein said solenoid means has a coil fixed to said gas-passage member.

12. A gas cycle refrigerator of claim 9, wherein said one end of said plunger carries a spherical body which sealingly engages with said first seat surface when said solenoid is energized.

13. A gas cycle refrigerator of claim 8, wherein said gas-passage member has a larger outer diameter at the portion thereof which fluid-tightly passes through the partition wall dividing the first gas expansion chamber and said first pressure chamber, than at the portion thereof which fluid-tightly passes through the partition wall dividing the first pressure chamber and said second pressure chamber.

* * * * *